US006641424B1

(12) United States Patent
Hanak et al.

(10) Patent No.: US 6,641,424 B1
(45) Date of Patent: Nov. 4, 2003

(54) SQUIB CONNECTOR

(75) Inventors: Rupert Harry Stephen Hanak, London (GB); Paul David Sims, West Midlands (GB); Chrysostomos Petros Chrysostomou, Herts (GB); John Marsh, London (GB)

(73) Assignee: AMP of Great Britain Ltd., Middlesex (GB)

( * ) Notice: Subject to any disclaimer, the term of this patent is extended or adjusted under 35 U.S.C. 154(b) by 0 days.

(21) Appl. No.: 09/485,013

(22) PCT Filed: Jul. 24, 1998

(86) PCT No.: PCT/IB98/01125

§ 371 (c)(1),
(2), (4) Date: Aug. 24, 2000

(87) PCT Pub. No.: WO99/06243

PCT Pub. Date: Feb. 11, 1999

(30) Foreign Application Priority Data

Jul. 31, 1997 (GB) ..... 9716258
Sep. 29, 1997 (GB) ..... 9720661

(51) Int. Cl.[7] ..... H01R 13/627
(52) U.S. Cl. ..... 439/352; 439/358
(58) Field of Search ..... 439/352–354, 439/350, 372, 358

(56) References Cited

U.S. PATENT DOCUMENTS

| | | | | |
|---|---|---|---|---|
| 5,275,575 A | | 1/1994 | Cahaly et al. | 439/188 |
| 5,529,512 A | | 6/1996 | Mlyniec | 439/352 |
| 5,595,499 A | * | 1/1997 | Zander et al. | 439/352 |
| 5,609,498 A | | 3/1997 | Muzslay | 439/352 |
| 5,688,141 A | | 11/1997 | Dullin | 439/352 |

FOREIGN PATENT DOCUMENTS

| | | | |
|---|---|---|---|
| DE | 19544631 A1 | 3/1997 | H01R/35/00 |
| EP | 713 266 A2 | 5/1996 | H01R/13/627 |
| EP | 736 934 B1 | 10/1996 | H01R/13/627 |
| EP | 791 987 A2 | 8/1997 | H01R/13/636 |
| EP | 808 749 A2 | 11/1997 | H01R/13/62 |
| GB | 2 310 087 A | 8/1997 | H01R/13/639 |

* cited by examiner

*Primary Examiner*—Khiem Nguyen

(57) ABSTRACT

A squib connector that has a slideable locking element with a locking protrusion for engaging a portion of the squib connector housing in the fully locked position where the locking protrusions are thus outwardly biased into locking engagement with the squib and any tension on the cable or connector housing tends to splay apart the locking arms into tighter engagement against the squib locking shoulders.

20 Claims, 15 Drawing Sheets

SQUIB CONNECTOR

BACKGROUND OF THE INVENTION

1. Field of the Invention

This invention relates to a connector for connection to a gas generator (often called "squib").

2. Summary of the Prior Art

In automotive applications such as airbag and seat belt pretentioners, explosive devices are provided, such devices often called squibs. Squibs are typically provided with a pair of contacts projecting within a cavity for receiving and mating with a complementary connector, commonly called squib connector. A squib connector assembly typically comprises a short circuit element that bridges the pin contacts of the squib in the uncoupled state. During plugging, the shorting contacts are biased by the squib connector to break the short circuit. The short circuit contact is often provided within a housing fastened to the squib housing.

Conventional squib connectors have resilient latches that engage shoulders of the squib housing, the latches shaped as cantilever beams attached to the connector housing at one end, and extending to a free end. In some designs as disclosed in U.S. Pat. No. 5,275,575, and EP 736934, the squib connector latches are in form of resilient cantilever beams that automatically latch to shoulders of the squib housing, wherein a further safety peg is inserted between the latch and connector housing for preventing inadvertent release of the connector. The connector is released by removing the safety insertion element and pulling upwardly on the connector, whereby conical or tapered latching surfaces on the resilient latch arms assist inward biasing of the latches for disengagement. As the latches provide a certain resistance, extraction requires relatively high forces that may damage the latches or the connector, especially after a few plugging and unplugging cycles. In view of reducing insertion forces during plugging it is known to positively outwardly bias the latch members during plugging with the safety element, as disclosed in U.S. Pat. No. 5,525,512. Unplugging may however be unreliable, if the resiliency of the latches diminishes over the life of the connector such that the latches do not fully inwardly bias to the rest position during uncoupling. One of the problems with all of the above described designs, is that the need to insert a safety element between the locking or latch arm and the connector housing reduces available space for the housing and latches. The latches are thus relatively flimsy, or the housing portion receiving the terminals needs to be made more compact. It would be desirable to improve the robustness and/or provide more space for the connector housing. It may be noted that the squibs have cavities with standardised dimensions, typically in order of approximately 8–10 mm diameter.

Another problem of resilient latches is the resistance to uncoupling once the safety peg is removed, which is sometimes quite high when the connector is new, but that reduces after use due to wear and reduced elasticity of the plastic housing material subject to heat and vibration. It would be desirable to avoid high resistance and varying plugging/unplugging characteristics.

In many squib connectors, it is also common to provide latching arms that resiliently latch during coupling, but that require special tooling for uncoupling, for example as shown in U.S. Pat. No. 5,609,498. The use of special tooling is however often undesirable as it increases the costs of service and maintenance.

SUMMARY OF THE INVENTION

It is an object of this invention to provide a squib connector that can be rapidly and easily plugged and unplugged from a squib, but which is nevertheless particularly safe, reliable and robust. In particular, reliability of the connection should be maintained over the life of the connector, unaffected by the number of plugging and unplugging operations or environmental conditions such as heat and vibration.

Objects of this invention have been achieved by providing a squib connector according to claim 1. Disclosed herein is a squib connector having a mating portion adapted to be received within a cavity of a squib for electrical connection thereto, the mating portion of the squib connector comprising a housing and a locking element mounted on the housing, the locking element comprising a locking portion engagable against a complementary shoulder of the squib for securing the connector in the squib, wherein the locking element is movably mounted on the housing and further comprises a camming portion adapted to cam against a complementary camming portion of the housing thereby biasing the locking portion into engagement with the squib complementary latching shoulders when the locking element is moved from an unlocked position to a locked position during coupling of the connector to the squib. Advantageously therefore, locking can be quickly and easily effected whilst ensuring a secure fully locked position, and without depending on resiliency of the latches. High temperature, vibration, or other factors that may affect the strength and resiliency of the connector housing material will therefore not affect the reliability and ease of plugging and unplugging of the squib connector. Furthermore a robust construction may be provided by avoiding insertion of a safety element.

The locking portion may be provided on cantilever beams attached at one end remote from a mating end of the connector mating portion to the locking element, and extending therefrom to a free end directed towards the connector mating face. In their natural or free standing position the locking portions may be provided in a substantially fully disengaged position, the latches being fully outwardly biased into engagement with the squib latching shoulders during mating. The latter enables a relatively low plugging, and unplugging force to be provided. The locking element may be provided slideable in the mating direction, against an outer surface of the mating portion. The housing camming portion may comprise an outwardly protruding tapered surface proximate the mating face, for engaging the locking element camming portions provided proximate free ends of locking arms. The locking portion may be provided with a second release camming surface that engages the squib during uncoupling for biasing the locking portions out of the locked position. The release camming surface may be tapered and may form part of a locking surface of the locking portion that engages the complementary squib locking shoulder. A particularly simple and robust latching is thus provided. The connector housing may further comprise a lock return element that engages the locking arms or portions in their unlocked position to ensure the locking arms are returned fully to their initial position prior to coupling. The lock return elements also help to protect the locking arms from damage. The locking element may further comprise latches that secure the locking element in the fully coupled position relative to the connector housing, whereby the latches have camming portions that push the housing in the plugging direction during unlatching. This ensures that the locking element is returned to the uncoupled position during unplugging of the connector and squib.

Further advantageous aspects of this invention will be described in the claims, or will be apparent from the following description and drawings.

DETAILED DESCRIPTION OF THE PREFERRED EMBODIMENT

Figure 1:
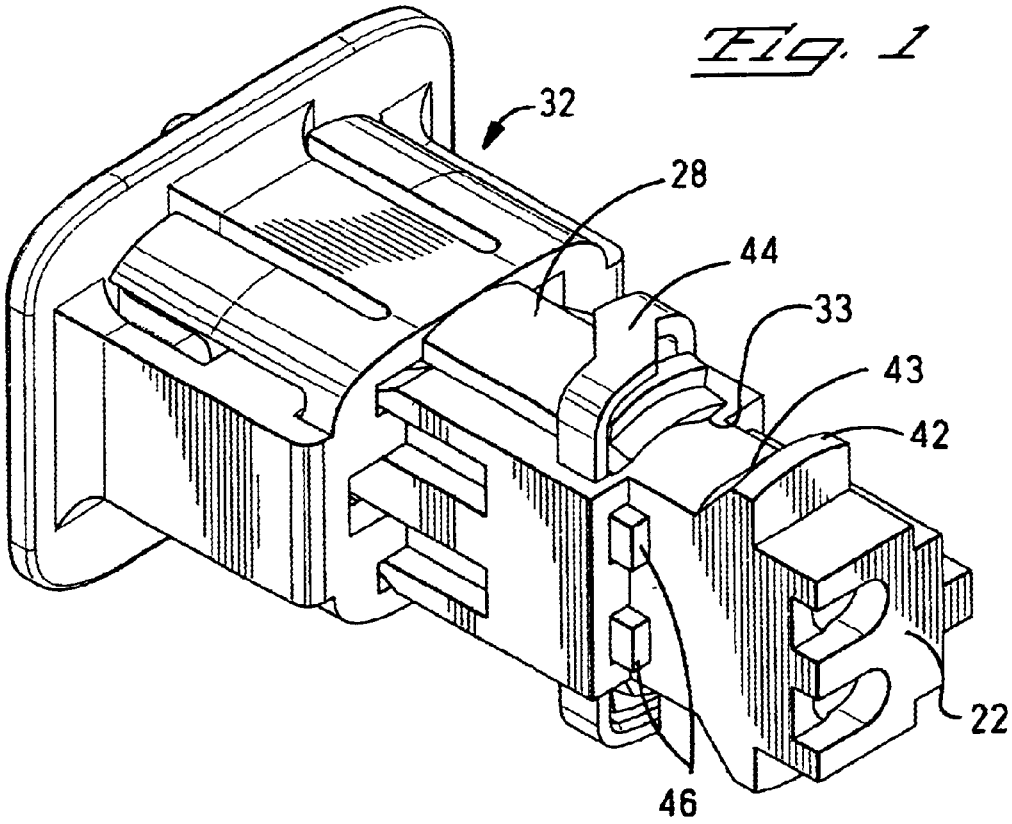
FIG. 1 is an isometric view of a squib connector according to this invention, with a locking element thereof in an unlocked position.
Figure 2:
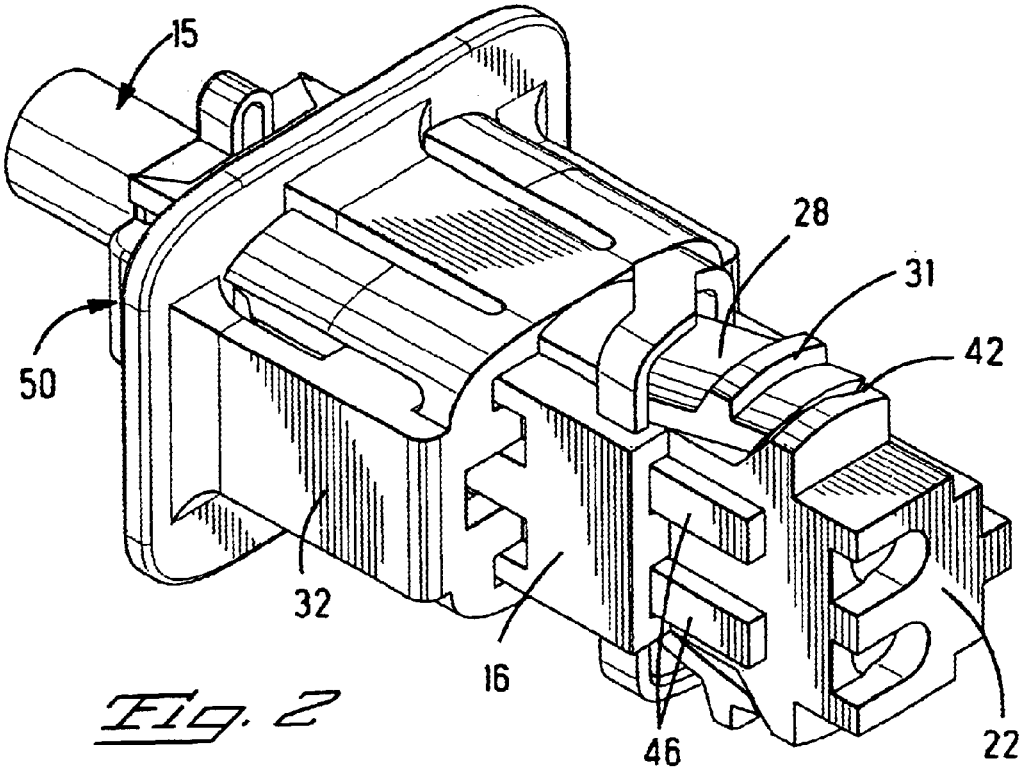
FIG. 2 is an isometric view similar to FIG. 1 with the locking element in the locked position.

Referring mainly to the FIGS. 1–8 a squib connector 2 is shown plugged to a connection portion of a gas generator (squib) 1 having a cavity 3 extending into the squib from a connector receiving face 4, the squib 1 further provided with a pair of contact pins 6 extending in the cavity 3. An annular locking recess 8 in the side of the cavity 3 forms a locking shoulder 10 for locking of the squib connector thereto. The assembly further comprises a shorting assembly 12 comprising an insulative housing and a shorting terminal (not shown) mounted in the housing for short circuiting the pair of contact pins 6 when the squib connector 2 is uncoupled from the squib 1.

The squib connector 2 comprises an insulative housing 16 having terminal receiving cavities 18 extending therethrough from a conductor receiving end 20 to a mating end 22 for receiving terminals 24 for plugging to the pin contacts 6. The housing 16 has a mating section 26 insertable within the squib cavity 3.

Figure 6:
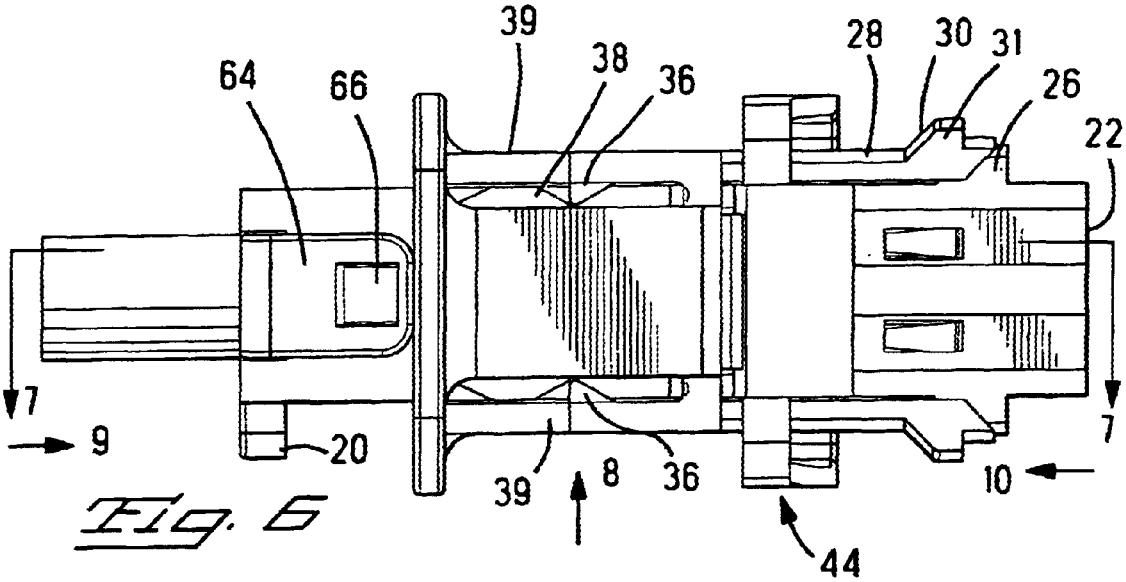
FIG. 6 is a side plan view of the squib connector.
Figure 8:
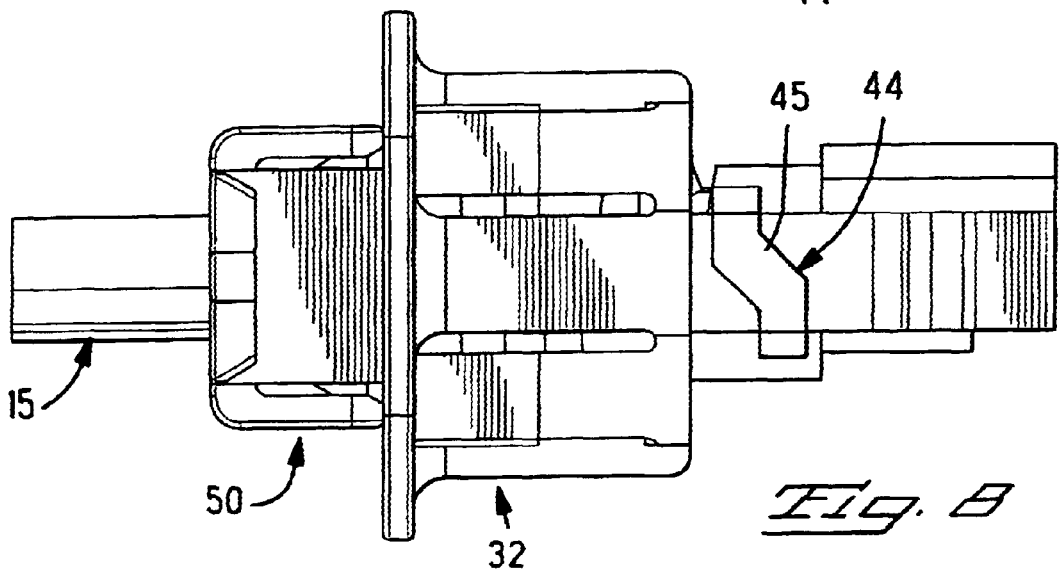
FIG. 8 is a view in the direction of arrow 8 of FIG. 6.
Figure 9:
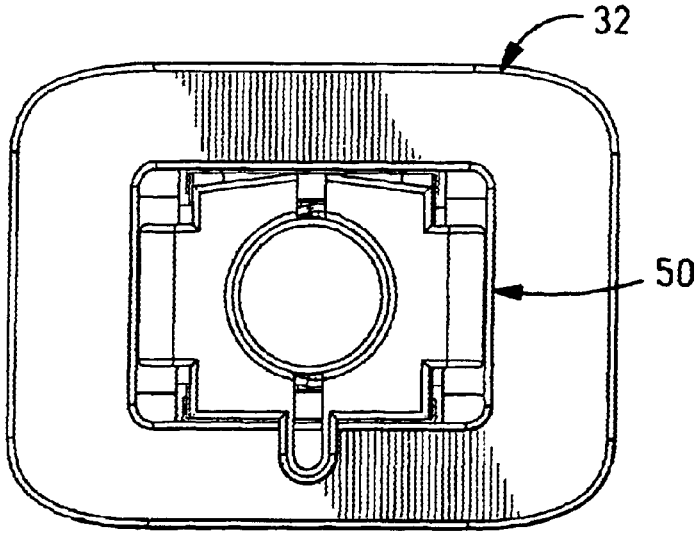
FIG. 9 is a view in the direction of arrow 9 of FIG. 6.
Figure 10:
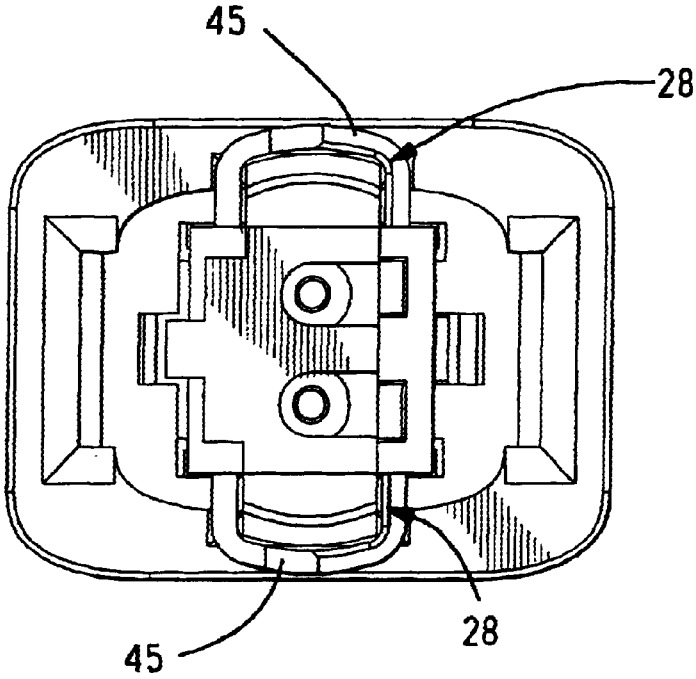
FIG. 10 is a view in the direction of arrow 10 of FIG. 6.
Figure 11:
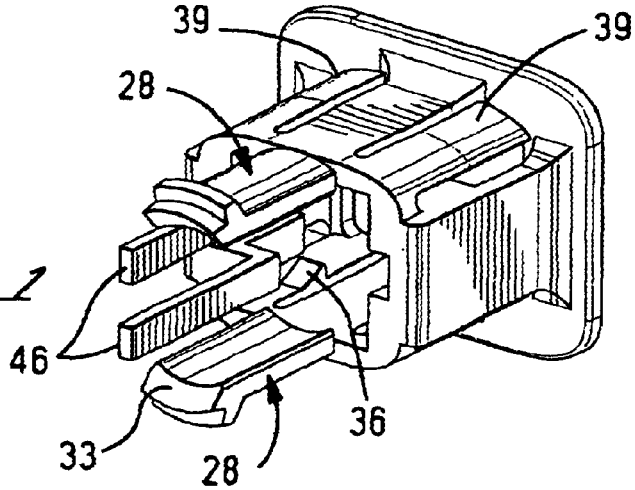
FIG. 11 is an isometric view of a locking element of the squib connector.
Figure 13:
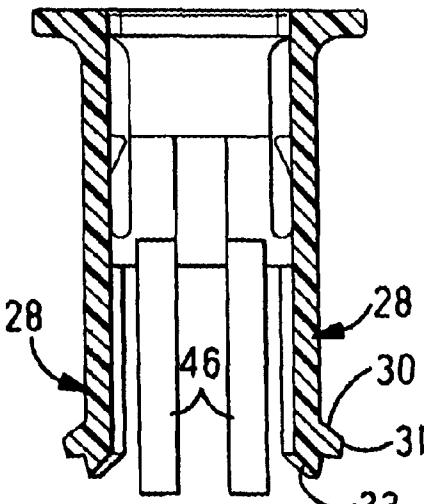
FIG. 13 is a cross sectional view through line 13—13 of FIG. 12.
Figure 12:
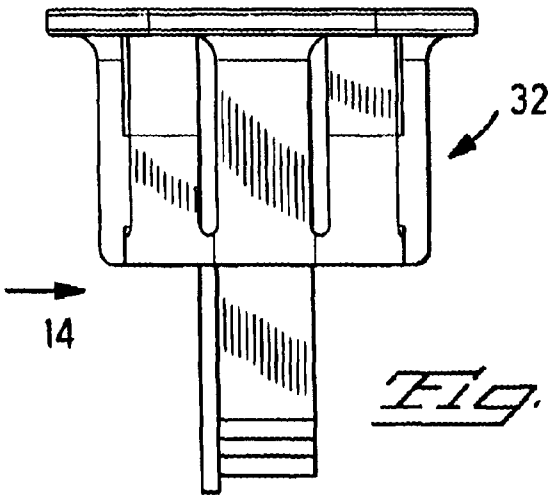
FIG. 12 is a side view of the locking element.
Figure 15:
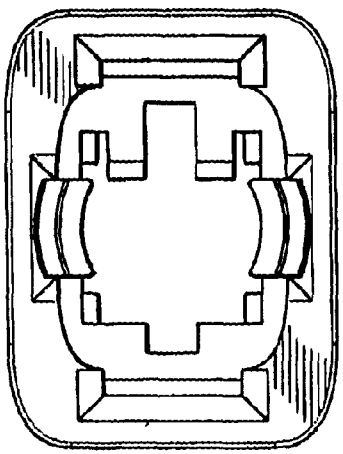
FIG. 15 is a view in the direction of arrow 15 of FIG. 14.
Figure 14:
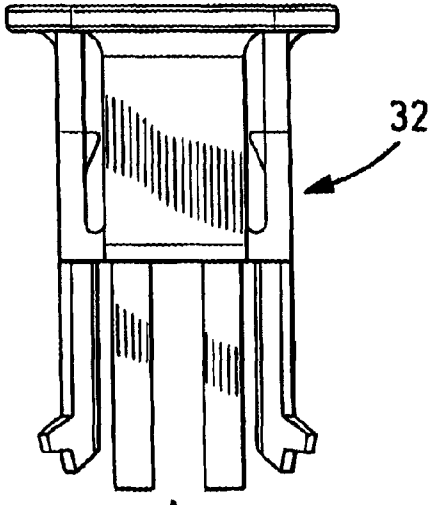
FIG. 14 is a view in the direction of arrow 14 of FIG. 12.
Figure 18:
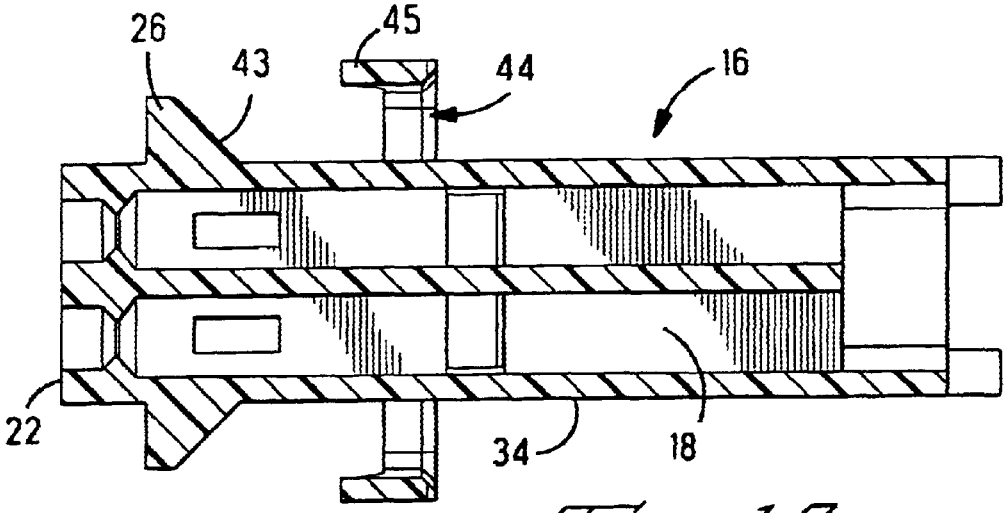
FIG. 18 is a cross sectional view through lines 18—18 of FIG. 16.
Figure 16:
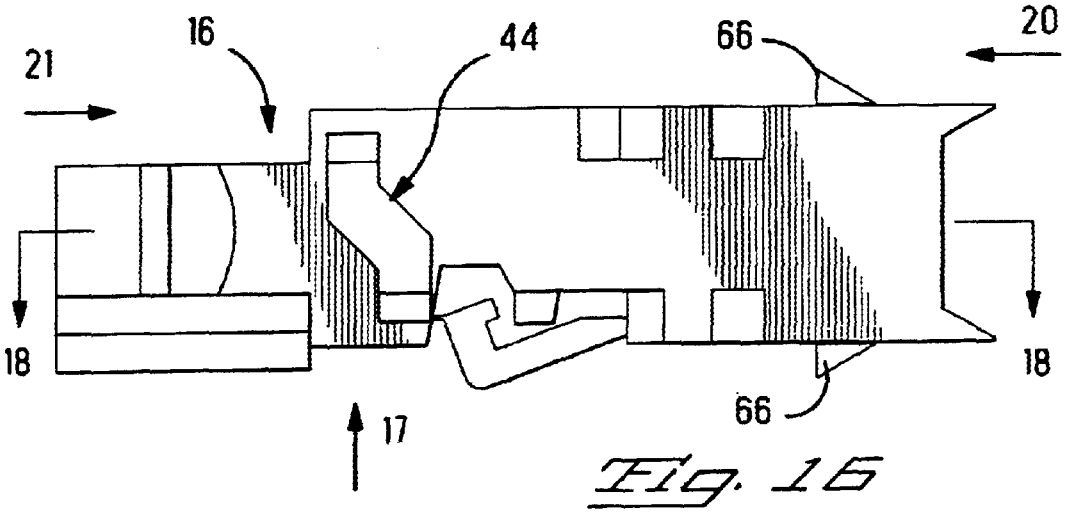
FIG. 16 is a side view of a squib connector housing.
Figure 17:
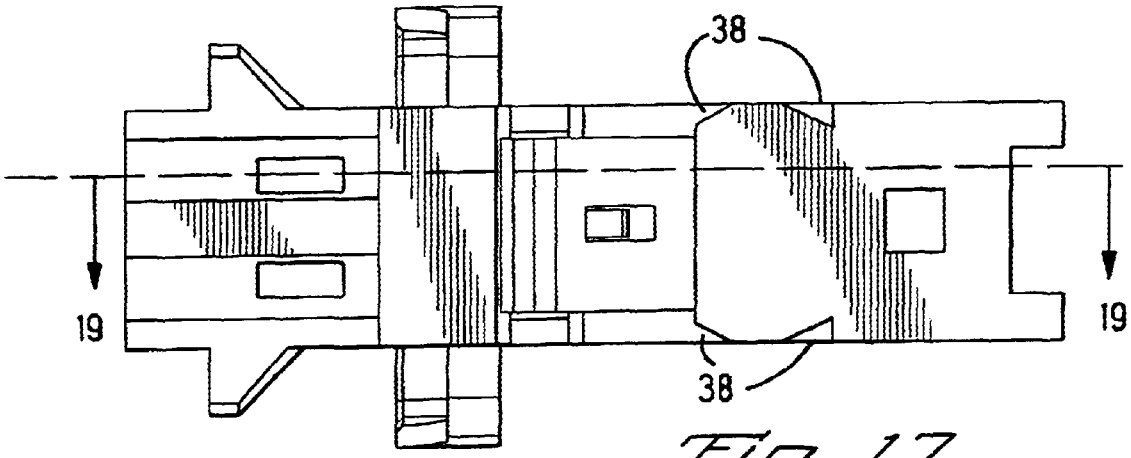
FIG. 17 is a view in the direction of arrow 17 of FIG. 16.
Figure 19:
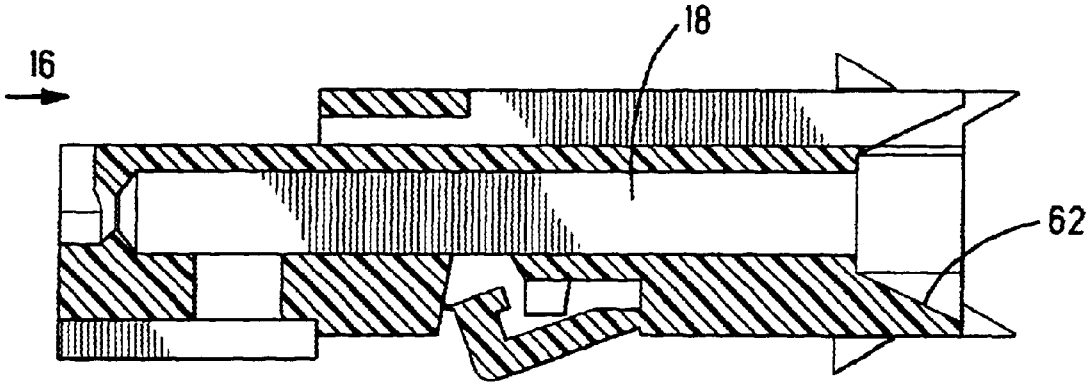
FIG. 19 is a cross sectional view through lines 19—19 of FIG. 17.
Figure 20:
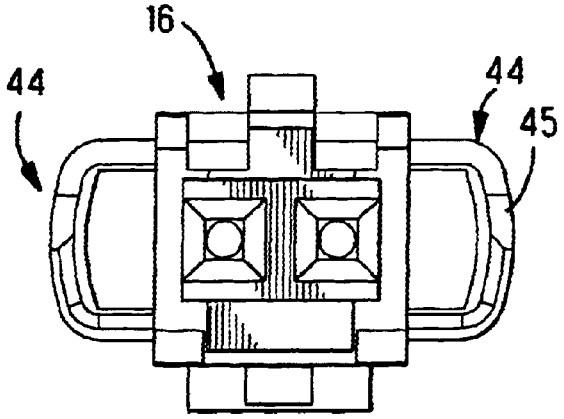
FIG. 20 is a view in the direction of arrow 20 of FIG. 16.
Figure 21:
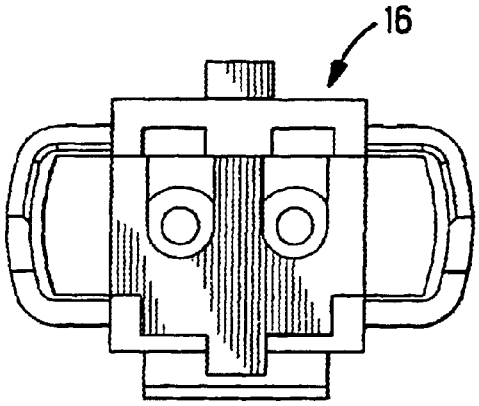
FIG. 21 is a view in the direction of arrow 21 of FIG. 16.
Figure 22:
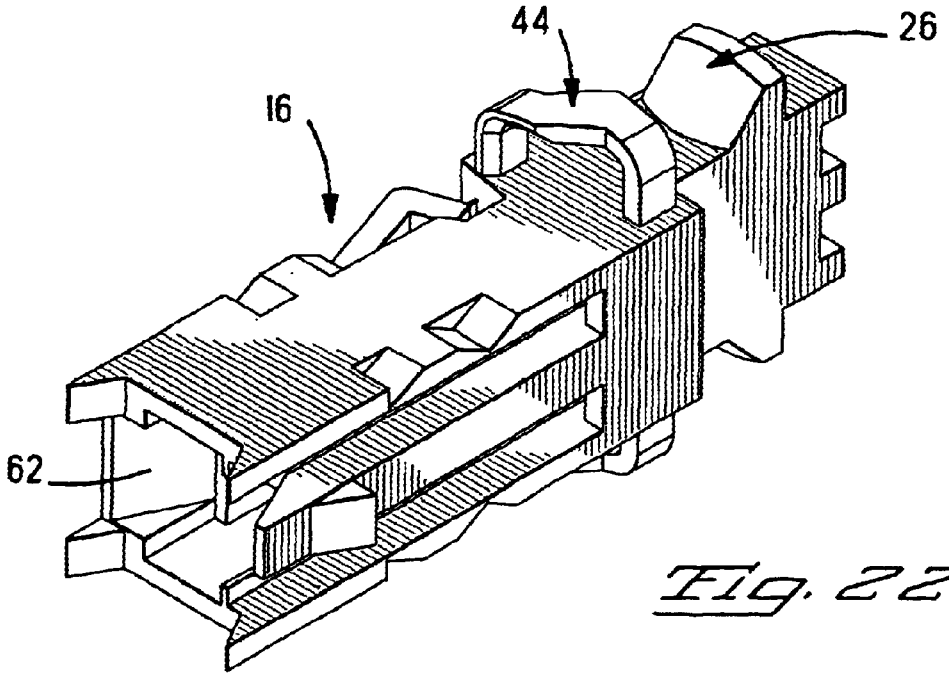
FIG. 22 is an isometric view of the connector housing.
Figure 27:
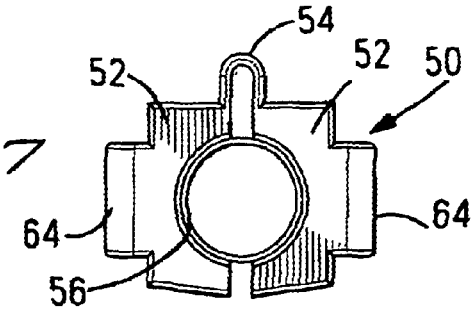
FIG. 27 is a view in the direction of arrow 27 of FIG. 23.
Figure 25:
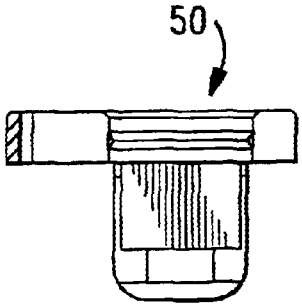
FIG. 25 is a cross sectional view through lines 25—25 of FIG. 23.
Figure 23:
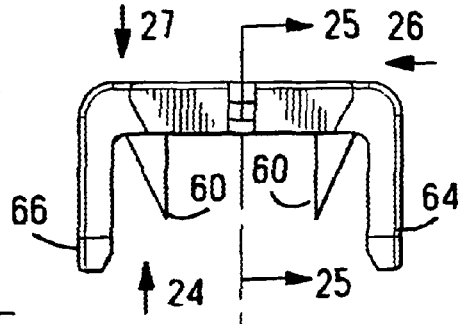
FIG. 23 is a side view of a strain relief member of the squib connector.
Figure 26:
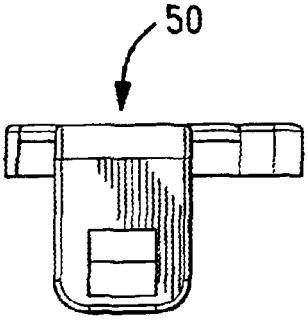
FIG. 26 is a view in the direction of arrow 26 of FIG. 23.
Figure 24:
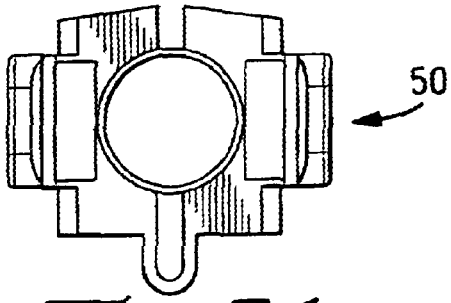
FIG. 24 is a view in the direction of arrow 24 of FIG. 23.
Figure 28:
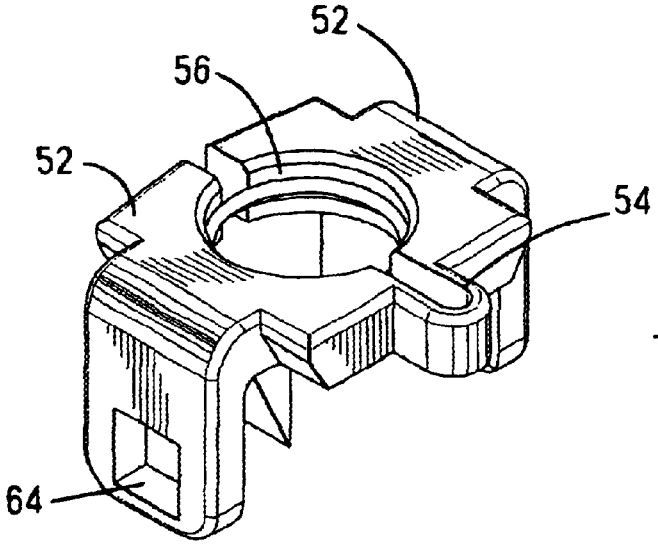
FIG. 28 is an isometric view of the strain relief member.
Figure 30:
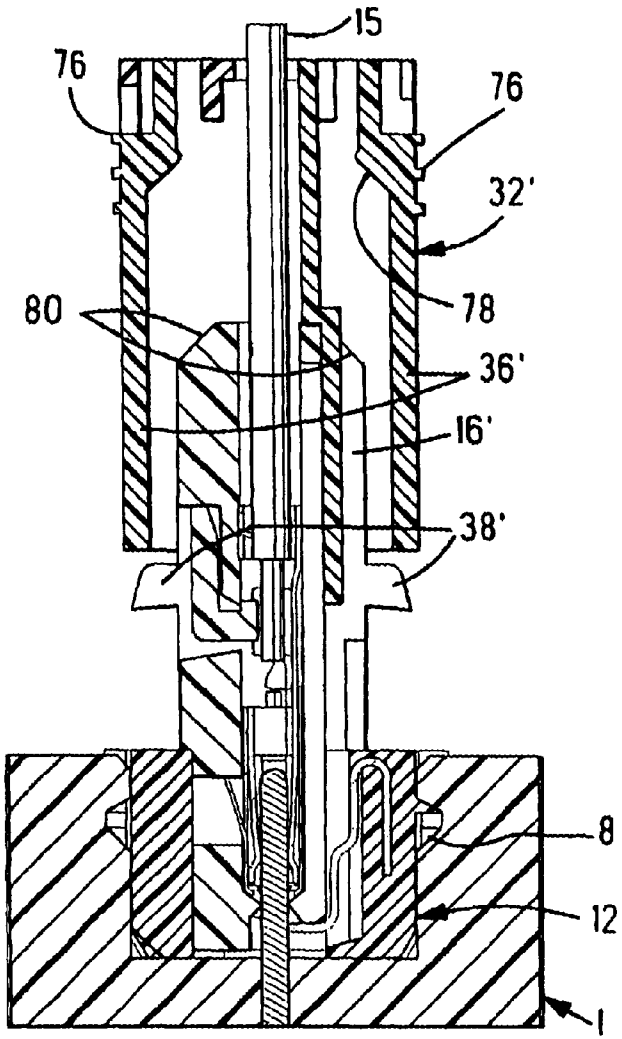
FIG. 30 is a cross-sectional view through lines 30—30 of FIG. 29.

The connector 2 further comprises a locking element 32 that is mounted slideably against an outer surface 34 of the housing 16, the locking element slideably movable in the direction of plugging and unplugging (P) of the connector. The locking element comprises a latching member 36 coupleable with complementary latching members 38 of the housing for securing the locking element in a fully locked position as shown in FIGS. 6, 11 and 17. The locking element latching members 36, 38 comprise complementary recesses 38 and notches 36, whereby resiliency is provided by the locking element side walls 39 that can bias outwards sufficient for engagement of the protrusions and recesses. The locking element further comprises locking arms 28 in the form of cantilever beams attached at an attachment end 29 to the locking element and extending therefrom to a free end directed towards the mating face 22, the locking arm 28 comprising a locking portion 31 provided with a tapered locking shoulder 30 for engaging the locking shoulder 10 of the squib. The tapered locking shoulder 30 also acts as a release camming surface that assists inward biasing of the locking arms 28 during disengagement sliding of the locking element. The locking arm further comprises a lock camming portion 33 in the shape of a tapered camming surface at the free end of the locking arm 28, for engaging a complementary tapered lock camming surface 43 of a complementary locking portion 42 that is integral with the housing 16. The housing locking portion 42 protrudes outwardly from the housing and is arranged in the mating section 26 proximate the mating face 22. The locking portion 42 engages and outwardly biases the locking arms 28 when the locking element is slid in the mating direction (P) into the fully locked position. Outward biasing of the locking arms 28 causes the locking shoulders 30 to engage the corresponding squib latching shoulders 10, as shown in FIG. 3.

Figure 3:
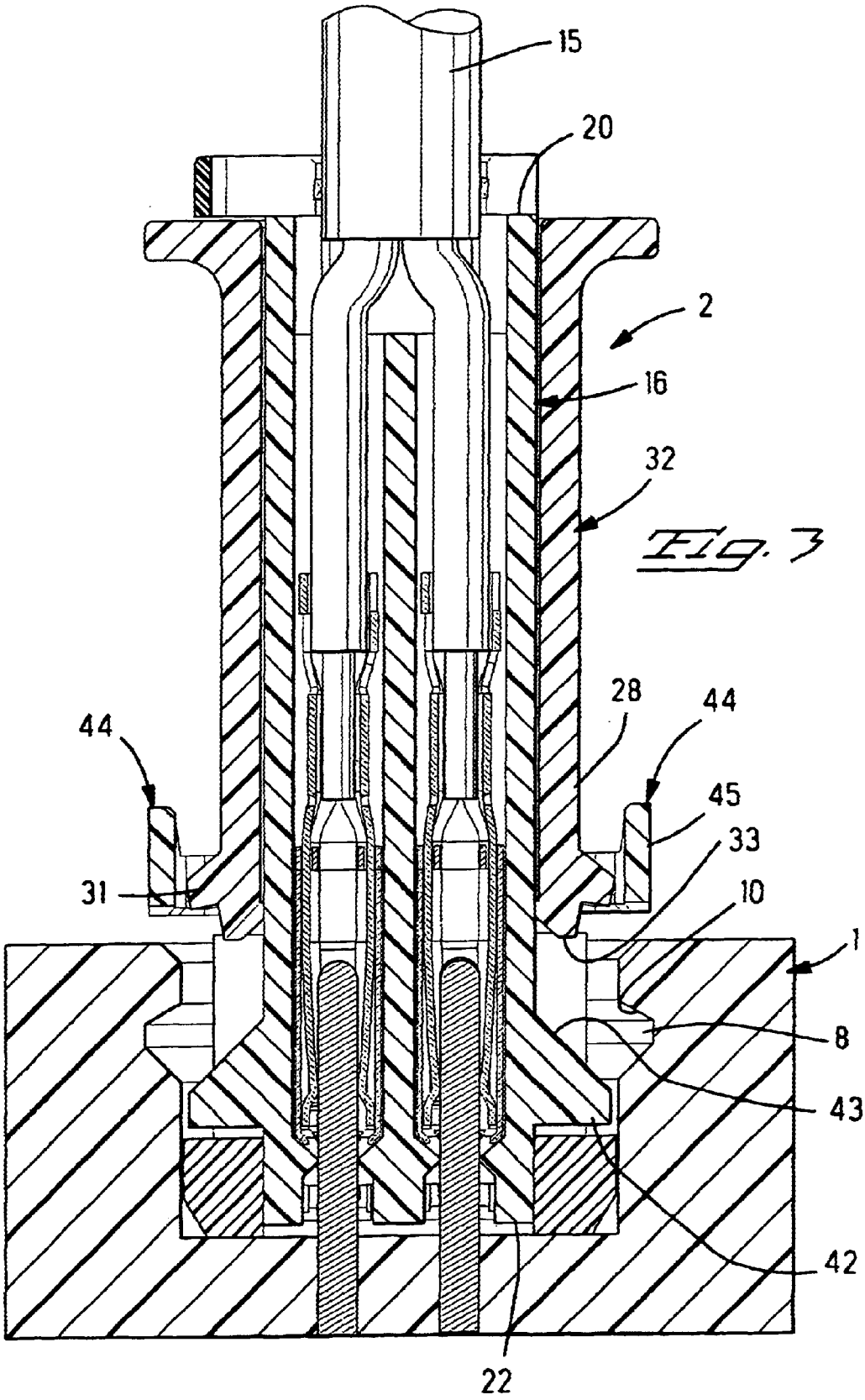
FIGS. 3 to 5 are cross sectional views through a squib connector being plugged to a squib, showing the stages of initial insertion, engagement of the locking element, and the fully locked position respectively.
Figure 4:
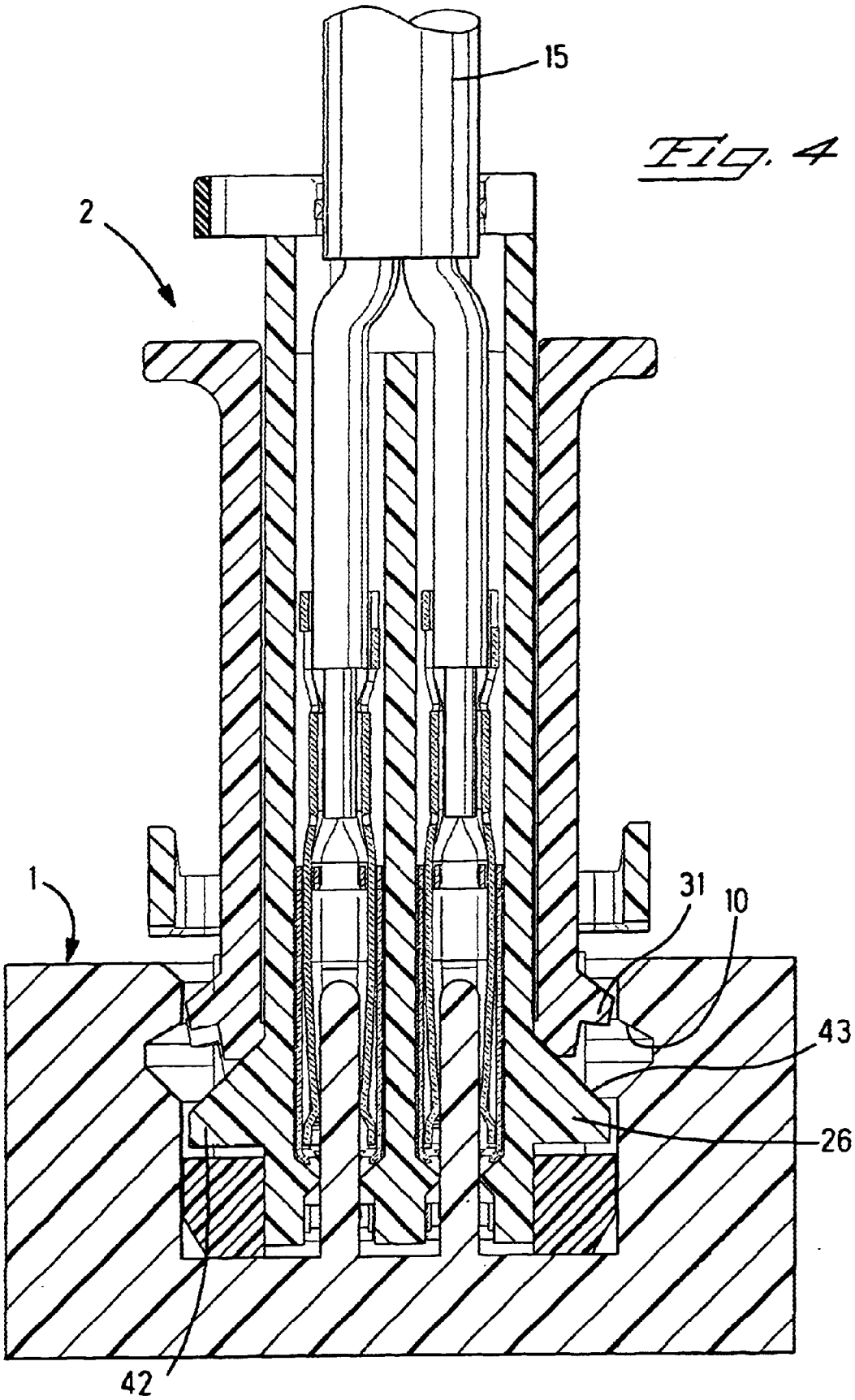
Figure 5:
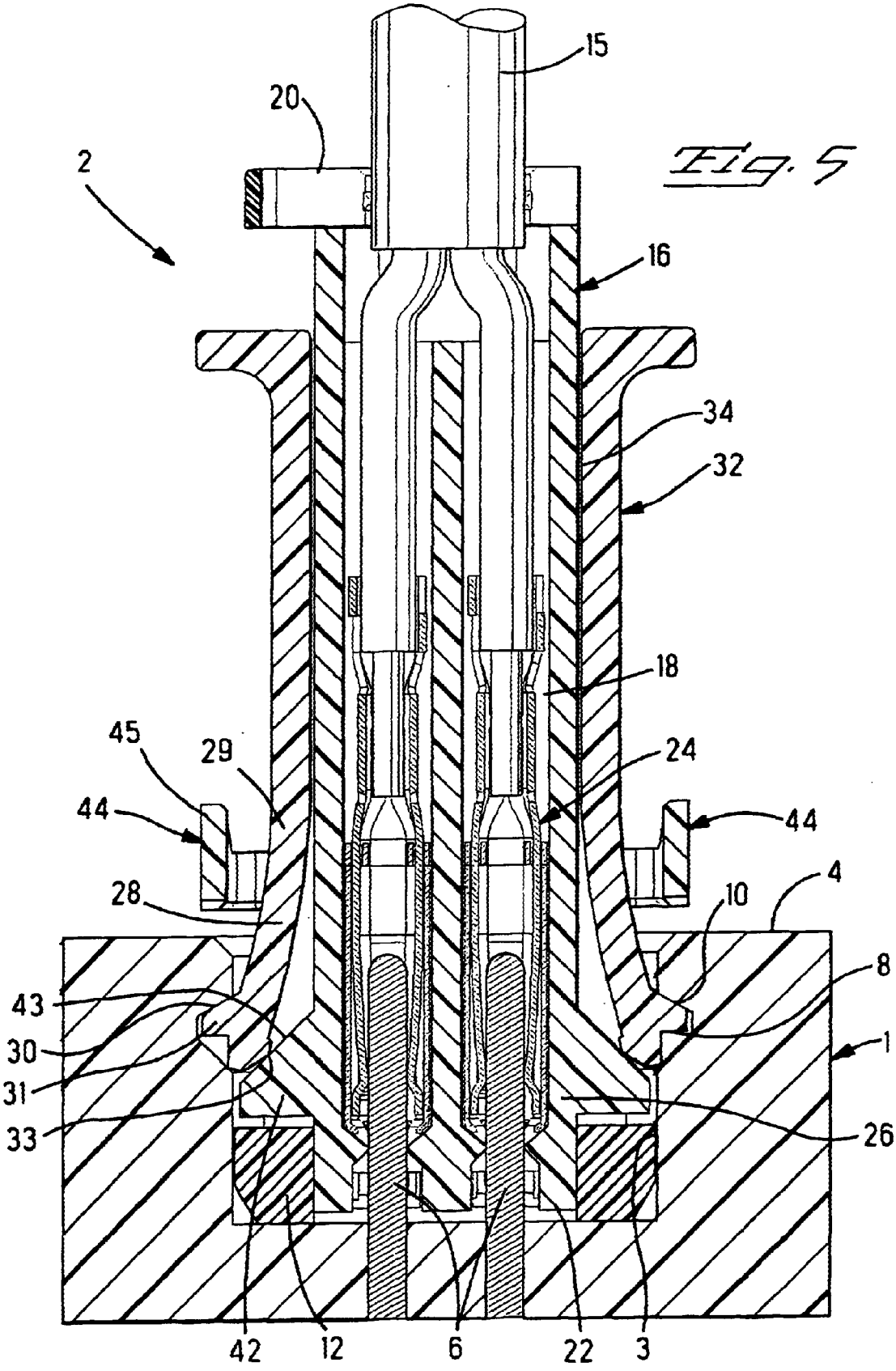
Figure 7:
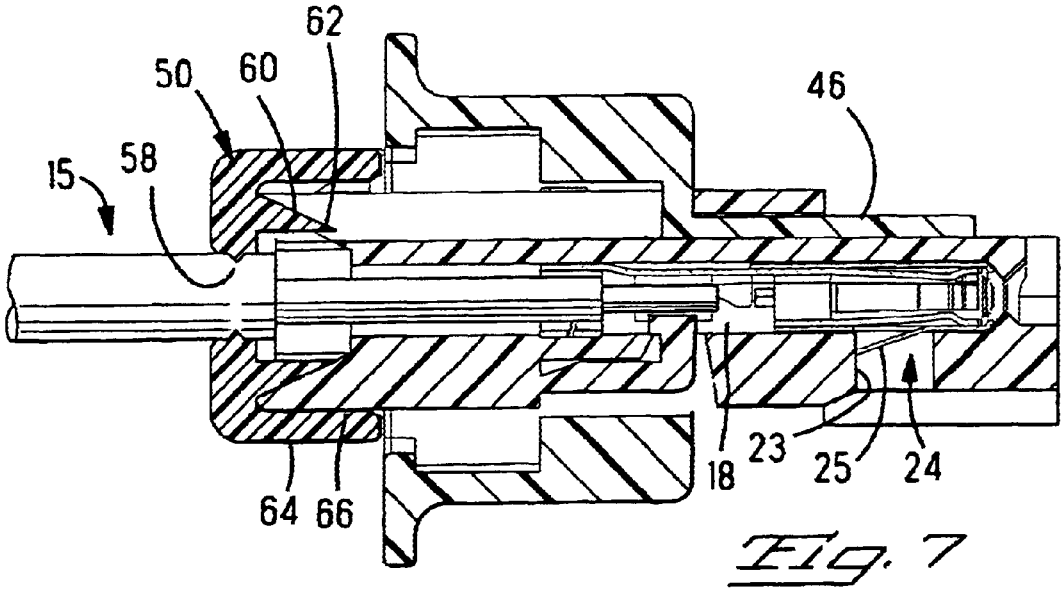
FIG. 7 is a cross sectional view through lines 7—7 of FIG. 6.

In the natural or free standing position of the locking arms as shown in FIGS. 3 and 4, there is little or no engagement between the locking shoulder 30 and the squib cavity 3 and locking shoulder 10, such that a low insertion force, and extraction force, is provided. Slight engagement of the locking shoulders 30, 10 during initial insertion as shown in FIG. 7, may be provided to ease plugging of the connector into the squib. Initial slight engagement provides the operator with some feel for indicating that the connector is fully inserted, and that the locking element can be depressed.

The locking element further comprises a return portion 44 which is formed by beams 45 integrally moulded to the housing 16 and spaced therefrom (see FIGS. 5 and 8), whereby the locking arms are arranged between the housing outer surface 34 and the beams 45. The return portion 44 inwardly cams the locking arms 28 during disengagement, in particular when the locking element 32 is slideably raised (in the direction P) from the fully locked to the unlocked position as shown in FIG. 3. Where the locking arms 28 are in a natural position out of engagement with the squib locking shoulders 10, then the return portions 44 may not actively inwardly cam the latch arms. In the event where the connector material loses resiliency or where the free standing position of the latches is designed to slightly engage the locking shoulders, or where the locking arms have been outwardly plastically deformed (for example damaged due to excessive extraction forces on the connector), then the return portions 44 will actively inwardly bias the latch arms 28, ensuring easy re-plugging of the connector. A reliable plugging and unplugging with low insertion and extraction forces is thus achieved, over the life time of the connector.

An important advantage of the present invention is the self-locking effect, as tension is exerted on the connector body 16 or cable 15. As an extraction force is exerted on the connector cable, the tapered housing locking shoulders 43 tend to splay apart the pair of opposed locking arms 28 in a even tighter engagement with the squib locking shoulder 10. A particularly robust and reliable locking is thus effected. In addition, as the connector does not rely on any particular resilient properties of the locking arms 28, they can be designed for optimal retention strength, and with relatively large thickness because of the omission of a further safety element. Yet further, the locking element locking protrusion 31 acts mainly in compression of the material, rather than shearing of a locking protrusion as in conventional designs, thereby further increasing the retention strength of the connector. This can be best understood by viewing FIG. 5, where the engagement forces compress along a line C that traverses the locking portion from the locking shoulder 30 to the camming portion surface 33 in compression, rather than shear. In certain squib designs where the locking shoulders 10 are not provided at an oblique angle the latter effect is not as prominent.

Referring to FIGS. 1, 2, 11 and 13, the locking element is further provided with a shunt actuation member 46 in the form of a pair of probes that is inserted between a spring arm of the shorting terminal (not shown) and the squib pin contacts 6, such that the shorting terminal is biased out of contact with the pins 6. Short circuiting is thus only deactivated when the locking element is moved to the fully locked position.

As best seen in FIGS. 7, 9 and 24–28, the connector further comprises a strain relief member 50 that comprises a pair of clamping portions 52 hinged together with a thin flexible hinge 54, the strain relief member provided with arcuate (semi-circle) ribbed clamping surfaces 56 for clamping and digging into the outer insulation of the cable 15. One rib is shown in FIG. 7 and denoted 58. The strain relief member 50 is received at a wire receiving end 20 of the connector, and comprises tapered or conical camming portions 60 received in a corresponding tapered conical recess 62 of the housing. The strain relief member 50 further comprises a pair latching arms 64 that engage opposed complementary latching elements in the form of protrusions 66 integrally formed with the housing 16. Assembly of the connector is thus effected by first terminating the assembly terminals 24 to conducting wires of the cable 15, and fully inserting and lodging the terminals within the terminal receiving cavities 18 (when the terminal locking lance 25 engages a corresponding locking shoulder 23 of the housing). The strain relief member is then mounted around the cable at the wire receiving end of the housing whereby the clamping portions 52 are pivoted together about the cable, and subsequently depressed towards the connector wire receiving face 20 such that the tapered actuation portion 60 engages within the corresponding camming recess 62 of the housing thereby forcing the clamping halves 52 together such that the ribs 58 dig into the outer insulation of the cable 15. The strain relief member 50 is depressed until the latching member 64, 66 engage. A simple and effective strain relief member that can be easily assembled to the connector is thus provided.

Figure 29:
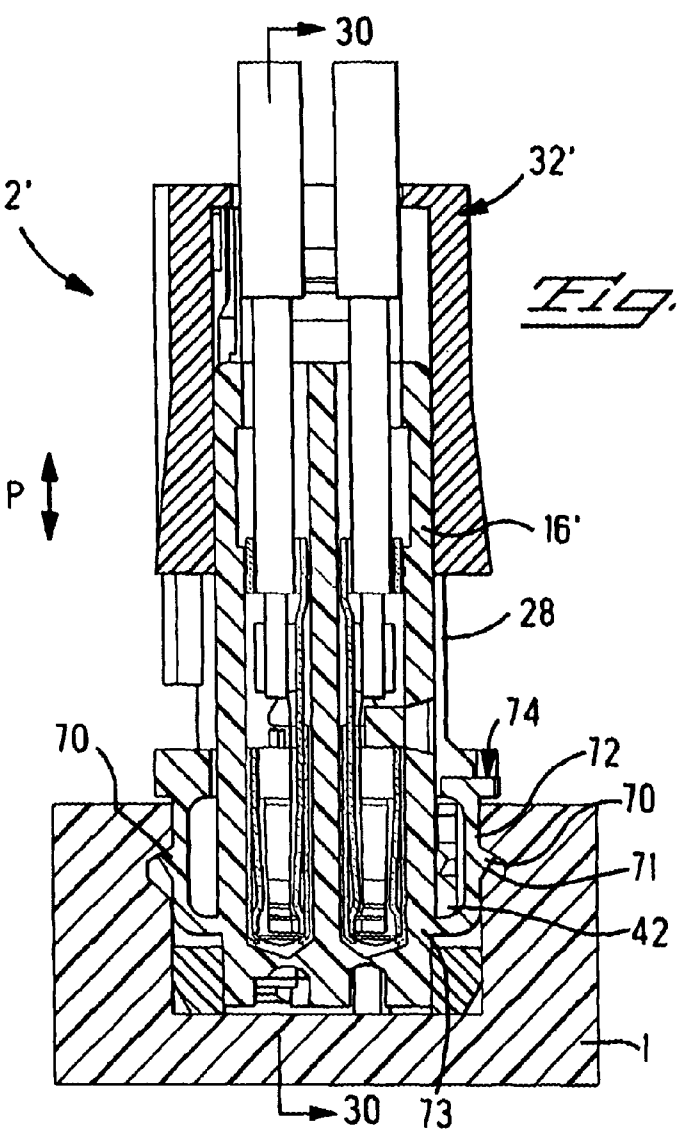
FIG. 29 is a cross-sectional view through another squib connector embodiment according to this invention, plugged to a gas generator.

A slightly different embodiment of the invention is shown in FIGS. 29–34. As many features of this embodiment are similar to the embodiment previously described, similar or identical features will be given the same numbering and features that are different or additional will be described. Referring to FIGS. 29–34, the squib connector 2' comprises a locking element 32' slideably movable in a plugging direction (P) on a housing 16' of the squib connector. The locking element 32' has locking arms 28 that co-operate with the gas generator 1 and the housing locking portion 26 in a similar manner to the embodiment of FIGS. 1–28. The housing 16' further comprises resilient coupling assist latches 70 having protrusions 71 mounted on resilient beams 72 attached to the housing at ends 73, 74. The latching protrusion 71 engages in the annular recess 8 of the gas generator for providing a partial retention of the squib connector to the gas generator during plugging and unplugging. The coupling assist latches 70 facilitate retraction of the slideable locking element 32' to the pre-assembly position as shown in FIG. 29 during unplugging, or during plugging the audible click and tactile feel of engagement of the latches 70 facilitate the plugging operation.

Figure 33:
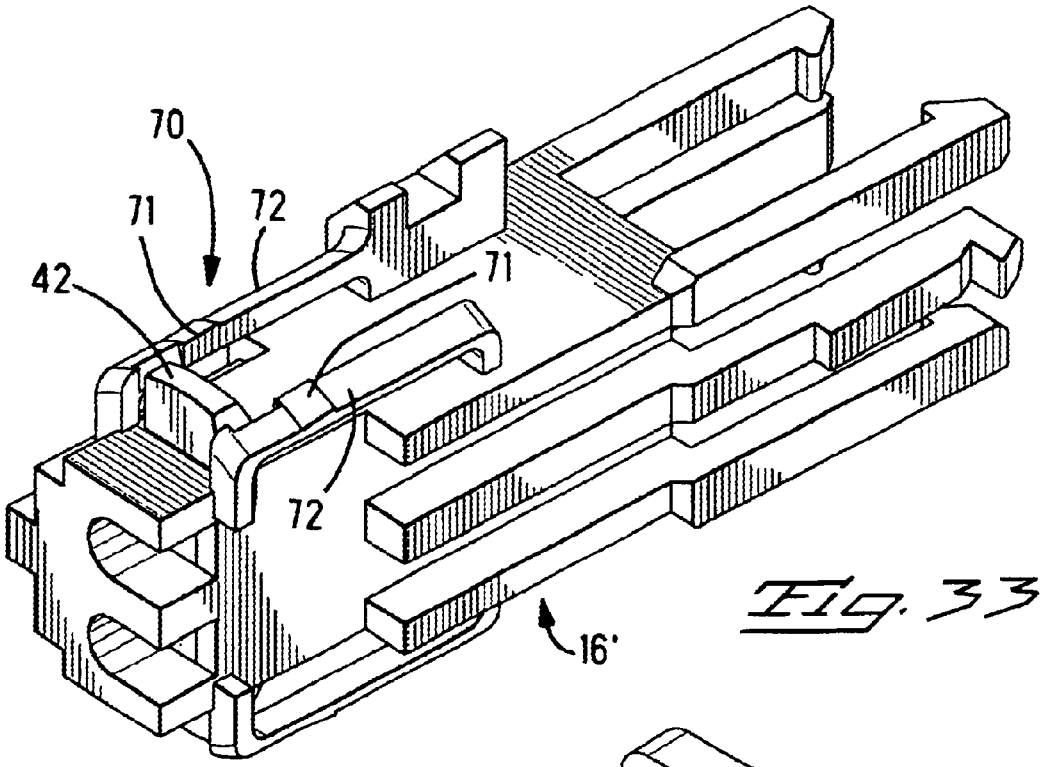
FIG. 33 is a isometric view of a housing of the embodiment of FIG. 29.
Figure 34:
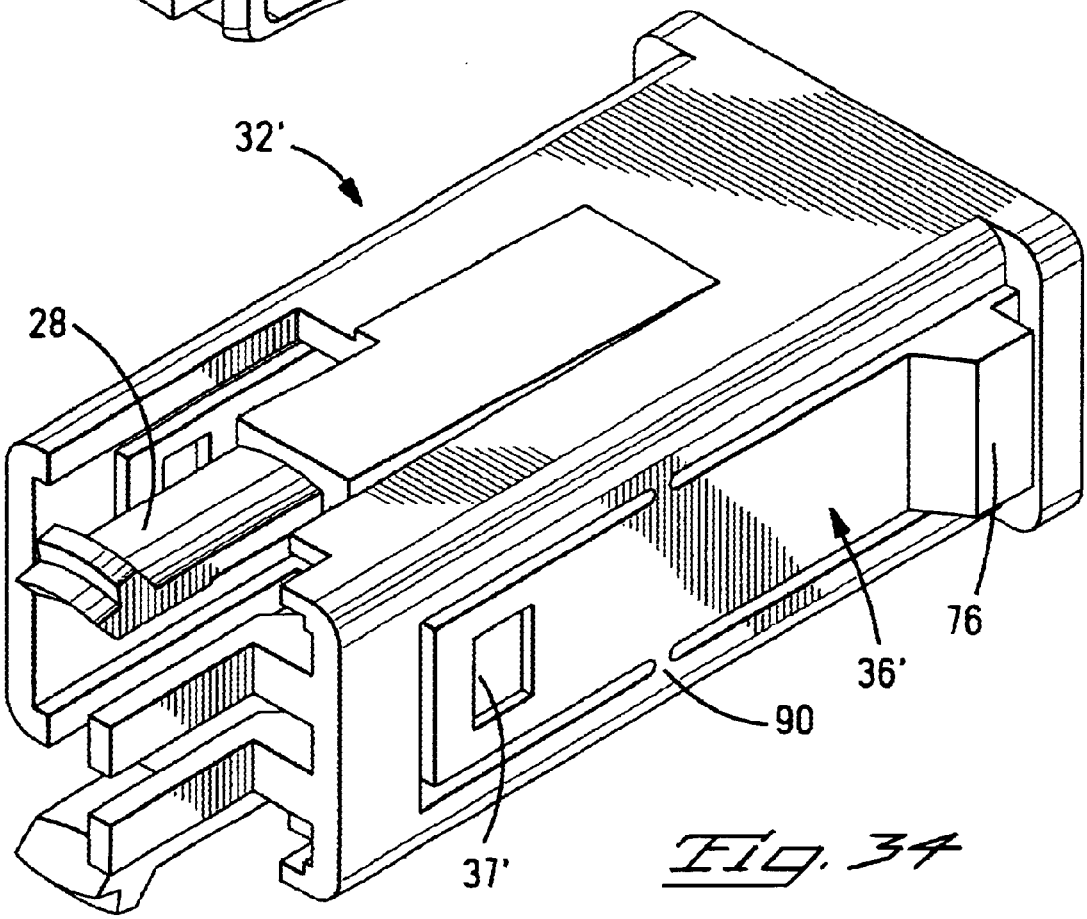
FIG. 34 is a isometric view of a locking element of the embodiment of FIG. 29.
Figure 35:
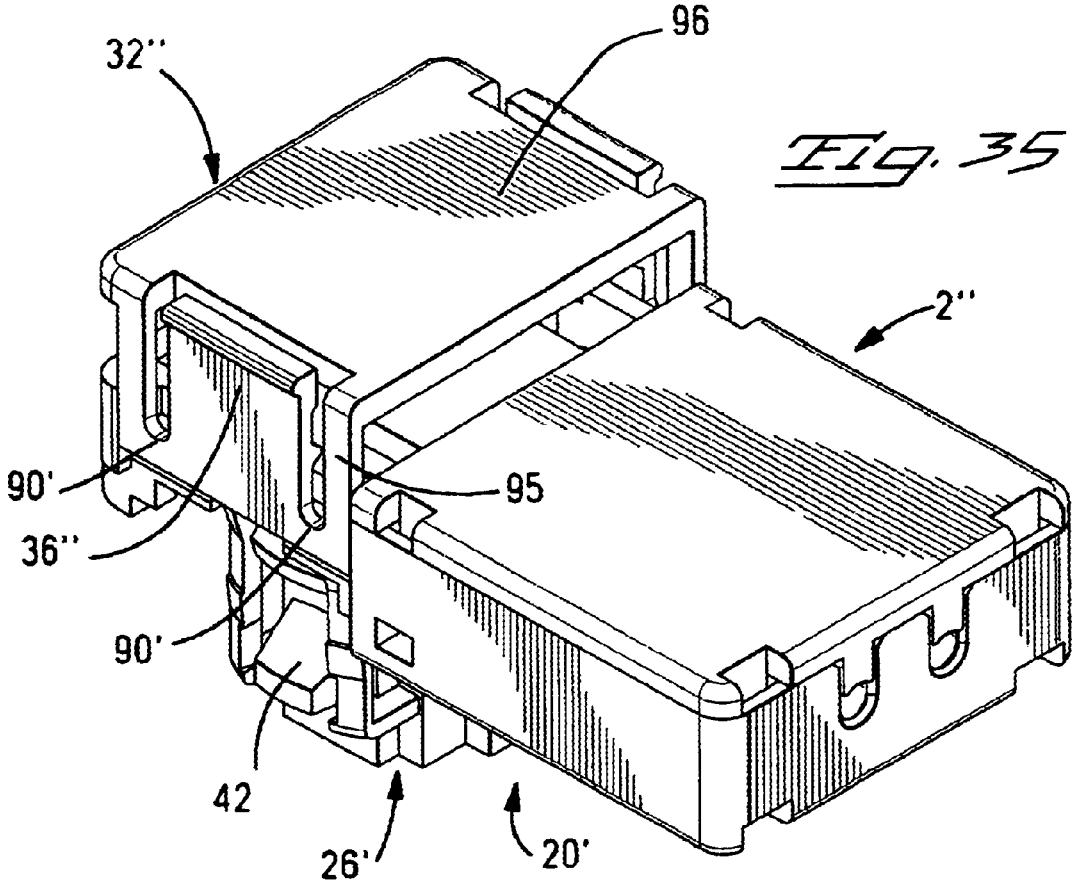
FIG. 35 is an isometric view of another embodiment in the uncoupled position.

As best seen in FIG. 33, each latch 70 comprises a pair of the beams 72, each beam arranged either side of the housing locking portion 42. The latches 70 are provided on opposing sides of the housing 16' proximate the opposed locking portions 42.

Figure 32:
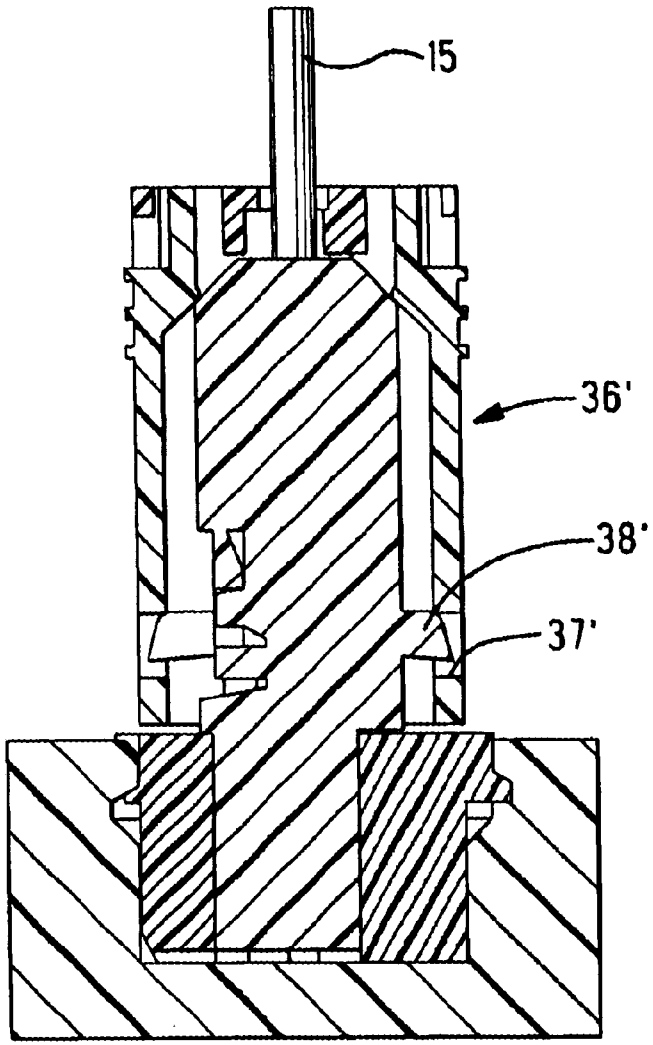
FIG. 32 is view similar to FIG. 31 showing initial unlatching of the squib connector from the gas generator.
Figure 31:
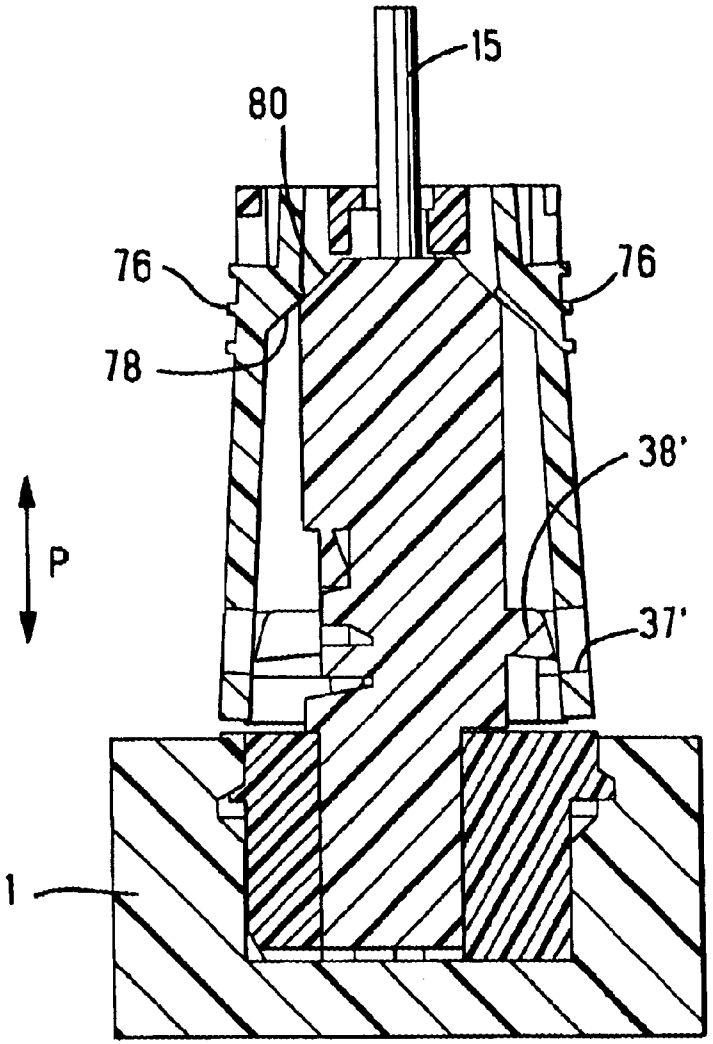
FIG. 31 is a simplified cross-sectional view similar to FIG. 30 showing the connector in the fully mated position.

The locking element 32' comprises a latching element 36' (see FIGS. 30, 34) that is resiliently pivotally mounted at hinges 90 on the locking element and has a locking shoulder 37' for engaging the latching shoulders 38' extending from the housing 16'. At an end remote from the locking shoulder 37', are finger grips 76 inwardly biasable for outwardly biasing the locking shoulders 37' as shown in FIG. 32. Proximate the finger grips 76, the latch arm 32' comprises camming shoulders 78 that co-operate with complementary camming shoulders 80 of the housing to generate a force component on the housing in the plugging direction (P) towards the gas generator 1. This ensures that during unlatching the latch arm locking shoulders 37' from the latch protrusions 38', the connector housing 16' is biased towards the gas generator to enable complete unlatching and sliding of the locking element 32' to the uncoupled position as shown in FIG. 29. Partial retention of the housing to the gas generator by the coupling assist latches 70 assist in ensuring complete return of the locking element 32'. Simple plugging and unplugging in a single action is thus provided. Nevertheless, extraction forces on the squib connector cable 15 cannot release the squib connector without destruction. In particular, an extraction force on the cable 15 tends to further tighten locking of the connector housing in the gas generator by outwardly splaying the locking arms 28.

Referring to FIGS. 35–38, another embodiment of a squib connector 2" is shown whereby the mating section 26' extends substantially orthogonally to the conductor receiving section 20' (i.e. in this embodiment the conductors terminated to the connector extend at 90 degrees to the plugging direction (P) of the connector to a squib). The mating section 26' however may have a similar construction to the mating section 26 of the aforementioned embodiments. One main difference between this embodiment and the previous embodiments, resides in the design of the locking element 32".

Figure 36:
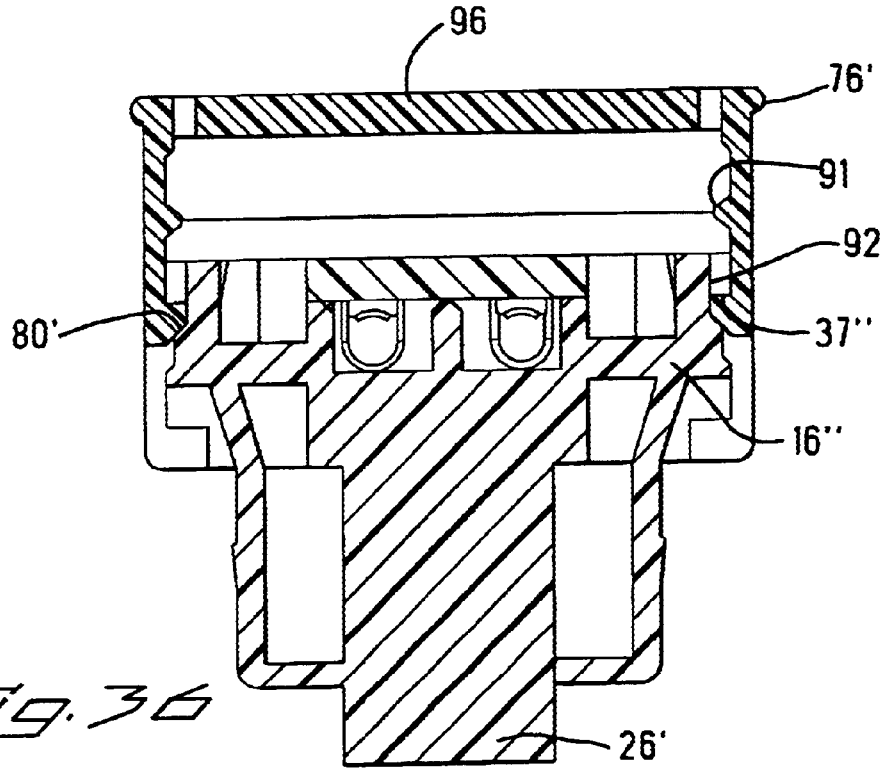
FIG. 36 is a simplified cross-sectional view of the embodiment of FIG. 35.
Figure 37:
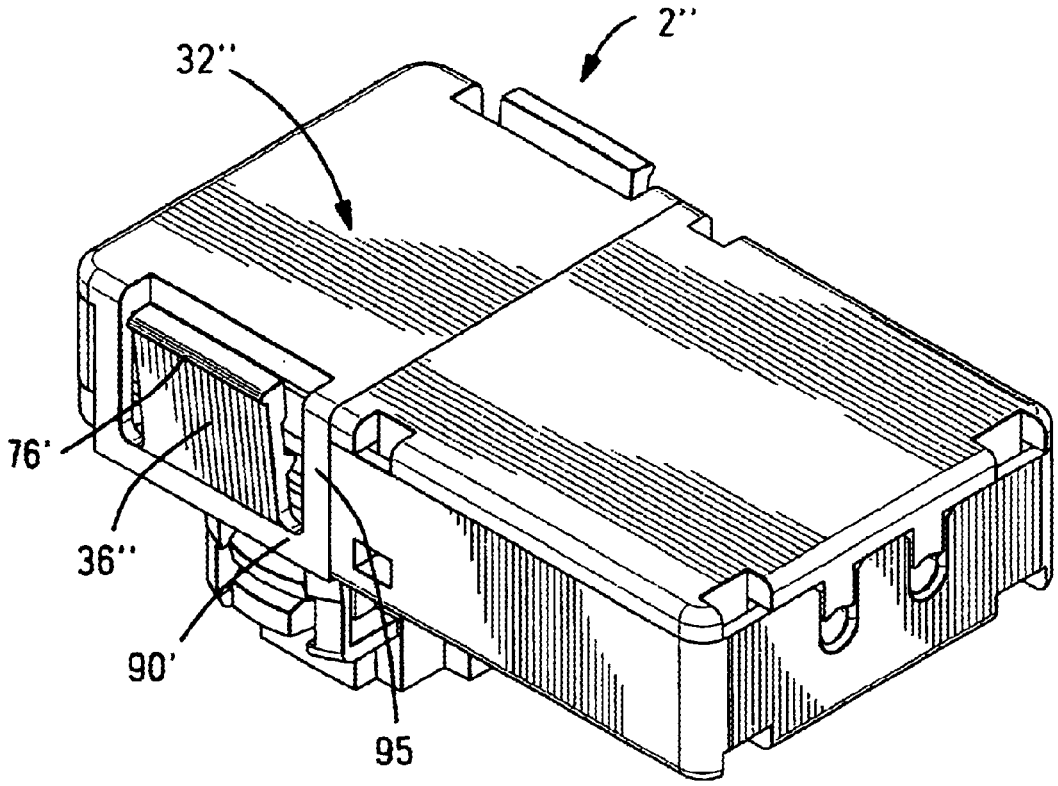
FIG. 37 is a view similar to FIG. 35 showing the locking element in the fully coupled position.
Figure 38:
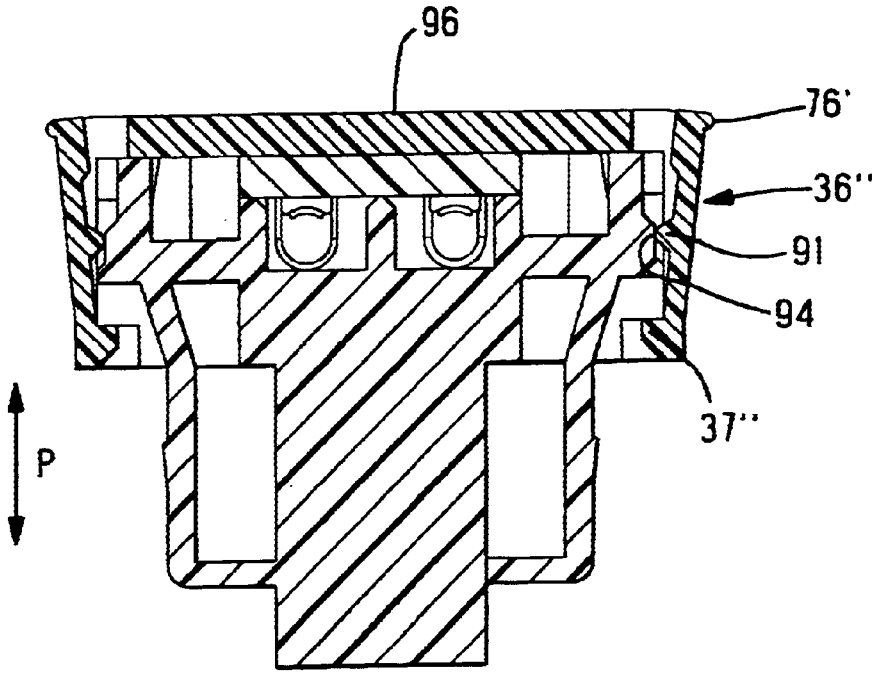
FIG. 38 is a simplified cross-sectional view of the embodiment of FIG. 37.

The locking element 32" comprises locking arms that engage the camming portions 42 of the mating section in a manner similar to the previously described embodiments. A main difference however is in the design of the latching element 36" that is resiliently integrally attached to the locking element 32" via thin hinges 90' proximate the locking shoulder 37" of the latching element 36". The latching element comprises a finger grip 76' at an upper end remote from the locking shoulder 37", and a pivot cam protrusion 91 on an inner surface of the latch for engagement with a side wall 92 of the squib connector housing 16". The side wall 92 has a tapered camming surface 80' which is positioned with respect to the locking slide intermediate a fully coupled position as shown in FIG. 38, and fully uncoupled position as shown in FIG. 36 such that during uncoupling the pivot cam protrusion 91 of the locking element rides along the tapered camming surface 80' thereby biasing the connector mating section 26' towards the squib. The latter helps to ensure, as in the previous embodiment of FIGS. 31–34, that the locking element is retracted to the fully uncoupled position during unplugging. In the fully coupled position as showing FIG. 38, the pivot protrusion 91 rides onto an outward flat cam surface 94 that maintains the latches 36" in an outwardly biased condition, thereby enabling quick and easy unplugging by squeezing together the latches whilst the mating section 26' is biased towards the squib. The spring force of the latch 36" is also provided by the spring beams 95 that extend from the hinges 90" to a top wall 96 of the locking element 32". A compact yet flexible latch element is thus provided, which is particularly advantageous for the 90 degrees embodiment of FIGS. 34–38 that preferably has a low height.

We claim:

1. A squib connector having a housing with a mating portion adapted to be received within a cavity of a squib for electrical connection thereto, the connector comprising: a locking element mounted on the housing having a locking portion engageable with a complementary locking shoulder of the squib for securing the connector to the squib, wherein the locking element is separate from and movably mounted to the housing, and has a lock camming portion that engages a complementary housing camming portion of the housing to cam the locking portions into engagement with the complementary locking shoulders of the squib when the locking element is moved from an unlocked position to a fully locked position during coupling of the connector to the squib.

2. The connector of claim 1 wherein the locking element is mounted to be slideable in a direction parallel to a direction of plugging and unplugging of the connector.

3. The connector of claim 2 wherein the locking portion is provided on a cantilever beam locking arm.

4. The connector of claim 3 wherein the connector locking arms are attached at an attachment end to the housing remote from a mating face of the housing, and extending therefrom to the latching portion provided proximate the mating face.

5. The connector of claim 3 wherein the locking arms are provided in a free standing or natural position that enables only slight or no engagement with the squib locking shoulders, whereby the housing camming portion outwardly biases the locking arms into engagement with the squib latching shoulders during movement of the locking element from the unlocked to the fully locked position.

6. The connector of claim 1 wherein the connector housing comprises a return cam portion that engage locking arms of the locking element when the locking element is moved to the fully unlocked position, engagement of the return cam portion by the locking arm ensuring biasing of the locking portions into an unlocked position, inwardly biased away from the squib cavity latching shoulders.

7. The connector of claim 6 wherein the return camming portion comprises a beam integrally attached to the connector housing and spaced therefrom for insertion of the locking arm between the beam and housing.

8. The connector of claim 1 wherein the housing camming portion is in the form of a protrusion extending outwardly from the housing and comprising a tapered camming surface for engagement of the lock camming portion thereagainst in order to outwardly splay the locking portions.

9. The connector of claim 1 wherein the locking portions of the locking element comprise tapered locking shoulders engageable against the squib latch shoulder whereby an extraction force on the connector housing or a cable attached to the housing compresses the locking portion along a compression direction that is at an angle with a direction of mating of the connector with the squib, thereby reducing shear forces on the locking portion.

10. The connector of claim 1 wherein the locking element comprises resilient latches with camming portions engageable with complementary camming portions of the housing during unlatching, the camming surfaces adapted to generate a force component on the housing in a plugging direction towards a squib.

11. A squib connector with a mating portion adapted to be received within a cavity of a squib for electrical connection thereto, the connector comprising:

a housing having a lock camming surface;

a locking element separate from and moveably mounted to the housing, the locking element having locking arms that extend proximate a locking shoulder of the squib that do not engage the locking shoulder in an unlocked position, the locking arms having a locking portion engageable with the locking shoulder for securing the connector to the squib and a camming portion that engages the camming surface of the housing to cam the locking portion into biased engagement with the locking shoulder of the squib when the locking element is moved from the unlocked position to a locked position.

12. The squib connector of claim 11, wherein the locking portion is provided on a cantilever beam locking arm.

13. The squib connector of claim 12, further comprising a return portion proximate the housing that cams the locking arm into an unbiased state when the locking element is moved from the locked position to the unlocked position.

14. The squib connector of claim 13, wherein the return portion includes a beam integrally moulded to the housing and spaced therefrom for receiving the locking arm therebetween.

15. The squib connector of claim 12, wherein the camming surface biases the locking arm into engagement with the locking shoulder when the locking element is in the locked position.

16. The squib connector of claim 11, wherein the camming surface is a protrusion extending outwardly from the housing and the protrusion has a tapered surface that outwardly splays the locking portion.

17. The squib connector of claim 11, further comprising a resilient coupling assist latch that locks the latching element in an unlocked position to ensure complete return of the locking element to the unlocked position.

18. The squib connector of claim 11, wherein the housing has a protrusion that engages a recess of the squib for partial retention of the connector to the squib during mating and unmating.

19. The squib connector of claim 11, wherein the mating portion of the squib connector extends substantially orthogonal to a conductor receiving section.

20. The squib connector of claim 11, wherein the locking element has a resilient latch with a camming projection engageable with a complementary surface of the housing during unlatching, the camming projection and the complementary surface of the housing adapted to generate a force component on the housing in a plugging direction towards the squib.

* * * * *